US011581656B2

(12) United States Patent
Buckley et al.

(10) Patent No.: US 11,581,656 B2
(45) Date of Patent: Feb. 14, 2023

(54) WIDE FREQUENCY RANGE DUAL POLARIZED RADIATING ELEMENT WITH INTEGRATED RADOME

(71) Applicants: Michael Buckley, Germantown, MD (US); Channasandra Ravishankar, Germantown, MD (US)

(72) Inventors: Michael Buckley, Germantown, MD (US); Channasandra Ravishankar, Germantown, MD (US)

(73) Assignee: Hughes Network Systems, LLC, Germantown, MD (US)

( * ) Notice: Subject to any disclaimer, the term of this patent is extended or adjusted under 35 U.S.C. 154(b) by 0 days.

(21) Appl. No.: 16/716,026

(22) Filed: Dec. 16, 2019

(65) Prior Publication Data

US 2021/0028553 A1 Jan. 28, 2021

Related U.S. Application Data

(60) Provisional application No. 62/877,042, filed on Jul. 22, 2019.

(51) Int. Cl.

| | |
|---|---|
| ***H01Q 21/00*** | (2006.01) |
| ***H01Q 1/42*** | (2006.01) |
| ***H01Q 21/24*** | (2006.01) |

(52) U.S. Cl.

CPC ..... *H01Q 21/0075* (2013.01); *H01Q 1/42* (2013.01); *H01Q 21/24* (2013.01)

(58) Field of Classification Search

CPC ..... H01Q 21/0075; H01Q 21/24; H01Q 1/42; H01Q 1/246; H01Q 1/38; H01Q 21/08

See application file for complete search history.

(56) References Cited

U.S. PATENT DOCUMENTS

| | | | | |
|---|---|---|---|---|
| 8,259,032 | B1 * | 9/2012 | Buckley | H01Q 1/40 343/909 |
| 8,872,713 | B1 * | 10/2014 | Buckley | H01Q 15/0086 343/767 |
| 9,825,372 | B1 * | 11/2017 | Buckley | H01Q 21/24 |
| 2016/0156105 | A1 * | 6/2016 | Buckley | H01Q 9/0414 343/767 |

OTHER PUBLICATIONS

"Higher Order Floquet Mode Radiating Elements", Michael J. Buckley, entire document (Year: 2016).*

Extended European Search Report for EP Application No. 20187058.1 dated Nov. 26, 2020.

Kolitsidas Ci et al: "Rectangular vs. equilateral triangular lattice comparison in a T-slot loaded strongly coupled dipole array", 2014 XXXITH URSI General Assembly and Scientific Symposium (URSI GASS), IEEE, Aug. 16, 2014 (Aug. 16, 2014), pp. 1-4, XP032663910,D01: 10.1109/URSIGASS.2014.6929166 [retrieved on Oct. 17, 2014].

* cited by examiner

*Primary Examiner* — David E Lotter

(74) *Attorney, Agent, or Firm* — Capitol City TechLaw; Jasbir Singh

(57) ABSTRACT

A low-profile array and a low-profile radiating element including: a stripline feed layer; a High Order Floquet (HOFS) part layer; and a radome layer in direct contact with the HOFS part layer, where the HOFS part layer is disposed between the stripline feed layer and the radome layer, and the radome layer includes a high dielectric constant (dk) environmentally robust material.

14 Claims, 8 Drawing Sheets

WIDE FREQUENCY RANGE DUAL POLARIZED RADIATING ELEMENT WITH INTEGRATED RADOME

CROSS-REFERENCE TO RELATED APPLICATIONS AND INCORPORATION BY REFERENCE

The present application claims the benefit under 35 U.S.C. 119(e) of U.S. Provisional Application Ser. No. 62/877,042, filed Jul. 22, 2019, which is incorporated herein by reference in its entirety.

FIELD

The present invention is directed generally toward antennas, and more particularly to electronically scanned antennas.

BACKGROUND

Current planar radiating element technology cannot provide a low-profile radiating element with relatively wide frequency range and scan volume and good polarization performance. A low profile dual polarized radiating element with an integrated radome having relatively wide frequency range and scan volume would be preferable.

SUMMARY

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter.

Accordingly, embodiments are directed to a novel apparatus that is a High Order Floquet (HOFS) wide frequency range dual polarized radiating element with an integrated radome. In some embodiments, the frequency range spans 10.7 to 14.5 GHz. In some embodiments, the dual polarization is provided as a horizontal and vertical polarization. In some embodiments, the integrated radome may include a high dielectric coefficient environmentally robust material, for example, quartz.

One general aspect includes a low-profile radiating element including: a stripline feed layer; a High Order Floquet (HOFS) part layer; and a radome layer in direct contact with the HOFS part layer, where the HOFS part layer is disposed between the stripline feed layer and the radome layer, and the radome layer includes a high dielectric constant (dk) environmentally robust material.

Implementations may include one or more of the following features. The radiating element where the HOFS part layer includes a first cluster of metallic striplines, generally elongated along a first axis, configured to produce a first signal having a first polarization. The radiating element may also include a second cluster of metallic striplines, generally elongated along a second axis substantially orthogonal to the first axis, configured to produce a second signal having a second polarization substantially orthogonal to the first polarization, where the first cluster is segregated from the second cluster. The radiating element where the first cluster is disposed in an equilateral triangular grid array. The radiating element where the radiating element is configured to operate in a frequency range including 10.7 to 14.5 GHz. The radiating element where the radiating element is configured to operate with a scan angle θ from 0° to 45° and a φ scan angle from 0° and 360°. The radiating element where the dielectric constant of the HOFS part layer is between 3.3 and 3.7. The radiating element where the radome layer includes a quartz layer and is integrated with the HOFS part layer. The radiating element where there is no gap between the HOFS part layer and the radome layer. The radiating element where the HOFS part layer includes a low loss FR-4 material such as Rogers 4003 or Megtron 6. The radiating element where the stripline feed layer, the HOFS part layer and the radome layer together form a PCB stack having a cross-section depth is less than or equal to 100 mils (2.54 millimeter).

One general aspect includes an array including: a plurality of low-profile radiating elements, each radiating element including a stripline feed layer; a High Order Floquet (HOFS) part layer; and a radome layer in direct contact with the HOFS part layer, where the HOFS part layer is disposed between the stripline feed layer and the radome layer, the radome layer includes a high dielectric constant (dk) environmentally robust material, and the radiating elements are arranged in an equilateral triangular array.

Implementations may include one or more of the following features. The array where the radome layer includes a layer of quartz. The array where the low-profile radiating element is configured to operate in Ku and X frequency bands. The array where the low-profile radiating element is configured to operate in a frequency range including 10.7 to 14.5 GHz with a scan angle θ from 0° to 45° and a φ scan angle from $0° \leq \varphi \leq 360°$. The array further including an upper metallization layer including a plurality of metallic striplines organized with substantial bilateral symmetry along both a first axis and a second axis orthogonal to the first axis.

Additional features will be set forth in the description that follows, and in part will be apparent from the description, or may be learned by practice of what is described.

DRAWINGS

In order to describe the manner in which the above-recited and other advantages and features may be obtained, a more particular description is provided below and will be rendered by reference to specific embodiments thereof which are illustrated in the appended drawings. Understanding that these drawings depict only typical embodiments and are not, therefore, to be limiting of its scope, implementations will be described and explained with additional specificity and detail with the accompanying drawings.

Figure 1:
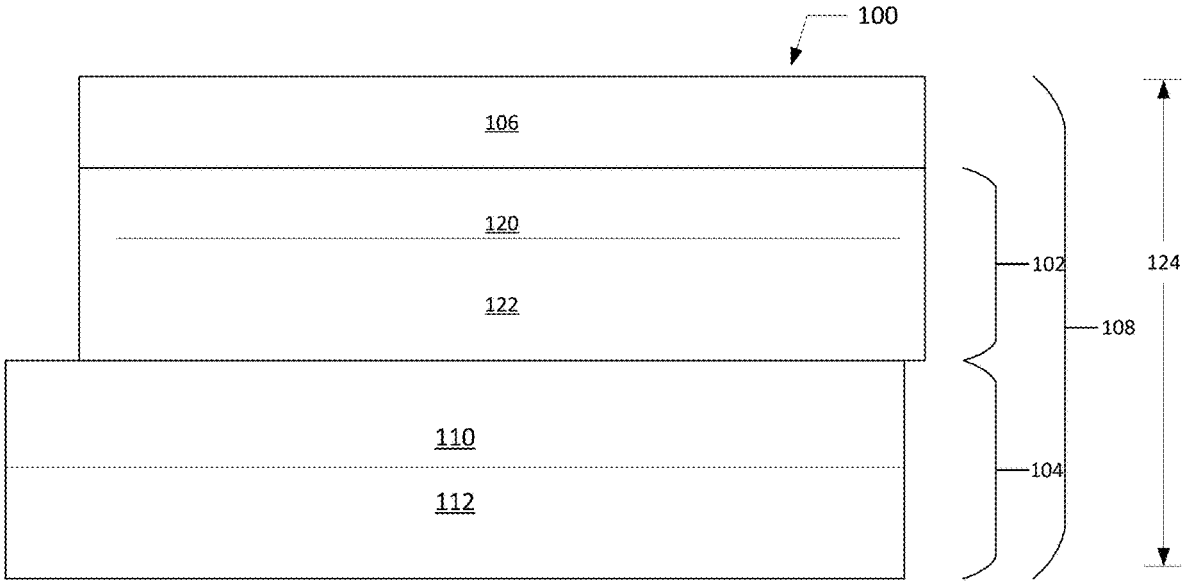
FIG. 1 shows a cross-sectional side view of a radiating element including a radome integrated with a PCB stack according to various embodiments.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Embodiments are discussed in detail below. While specific implementations are discussed, this is done for illustration purposes only. A person skilled in the relevant art will recognize that other components and configurations may be used without parting from the spirit and scope of the subject matter of this disclosure.

The terminology used herein is for describing embodiments only and is not intended to be limiting of the present disclosure. As used herein, the singular forms "a," "an" and "the" are intended to include the plural forms as well, unless the context clearly indicates otherwise. Furthermore, the use of the terms "a," "an," etc. does not denote a limitation of quantity but rather denotes the presence of at least one of the referenced items. The use of the terms "first," "second," and the like does not imply any order, but they are included to either identify individual elements or to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Although some features may be described with respect to individual exemplary embodiments, aspects need not be limited thereto such that features from one or more exemplary embodiments may be combinable with other features from one or more exemplary embodiments.

A low-profile antenna that includes a low-profile radiating element is desirable in many applications including aero applications. An integrated radome for the low-profile radiating element permits a low-profile deployment and reduces air drag induced by the airborne antenna. Moreover, low profile antennas are important for packaging and other deployments.

The low-profile radiating elements may be used in antennas that operate in a wide frequency range with large scan volume requirements such as satellite systems like the Low-Earth Orbit or Mid-Earth Orbit satellite systems. that need. The low-profile radiating elements may be used for vehicular and aeronautical applications in Low-Earth Orbit, Mid-Earth Orbit, Geosynchronous Earth Orbit, High Altitude Platform satellite systems.

FIG. 1 shows a cross-sectional side view of a radiating element including a radome integrated with a PCB stack according to various embodiments.

Referring to FIG. 1, a radiating element 100 includes a stripline feed layer 104, a High Order Floquet (HOFS) part layer 102 connected to the stripline feed layer 104 and a radome layer 106 connected to the HOFS part layer 102. The stripline feed layer 104 includes a first core 110 and a second core 112. The HOFS part layer 102 includes a first layer 120 and a second layer 122. The radiating element 100 may be implemented as a printed circuit board (PCB) stack 108. The PCB stack 108 may be manufactured with the radome layer 106 such that there is no air gap between the radome layer 106 and the PCB stack 108. In some embodiments, the PCB stack 108 and the radome layer 106 are in direct contact. The PCB stack 108 includes the HOFS part layer 102 and the stripline feed layer 104. Each of the first core 110, the second core 112, the first layer 120 and the second layer 122 may include printed circuit patterns. In some embodiments, a coupling from the HOFS part layer 102 to the stripline feed layer 104 is through slots (see FIG. 2) cut in a top ground plane of the stripline feed layer 104.

In some embodiments, an electronically scanned antenna including a plurality of the radiating elements disposed in an equilateral triangle grid array (see FIG. 15) may be implemented with the printed circuit board (PCB) stack 108. A cross-section depth 124 of the PCB stack 108. The HOFS part layer 102 has a number of printed circuit board layers; all printed circuit board layers include a high dielectric constant material suitable for FR-4 or Megtron 6 manufacturing processes. The printed circuit board is balanced to reduce warping.

In some embodiments, a thickness of the radome layer 106 of the radiating element 100 may be as little as 20 mil (0.508 mm). The first layer 120 of the HOFS part layer 102 may have a thickness of 10 mil (0.254 mm) and the second layer 122 of the HOFS part layer 102 may have s a thickness of 30 mil (0.762 mm). The first core 110 of the stripline feed layer 104 may have a thickness of about 20 mil (0.508 millimeters) and the second core 112 of the stripline feed layer 104 may have a thickness of about 20 mil (0.508 millimeters). In some embodiments, a stack height of the PCB stack 108 (layers including the HOFS part layer 102, the stripline feed layer 104 and the radome layer 106) maybe less than or equal to 100 mils (2.54 mm). In some embodiments, the radiating elements may be disposed in an equilateral triangle grid array. Such an embodiment scans well over a wide frequency range and offers low cross-polar radiation.

The stripline feed layer 104 and the HOFS part layer 102 may include a high dielectric constant material such as Rogers 4003, Rogers 3003, Rogers 5880 LZ or similar material. Rogers 3003 and Rogers 5880 LZ are exemplary Teflon based materials. Rogers 4003 is an exemplary low cost and low loss FR-4 based material. Herein, high dielectric constant may be understood to refer generally to a dielectric greater than 3.3. Embodiments of the present invention are directed specifically toward materials with a dielectric constant of between 3.3 and 3.7, though a person of ordinary skill in the art having the benefit of the disclosure may appreciate that other dielectric constants are envisioned.

Figure 2:
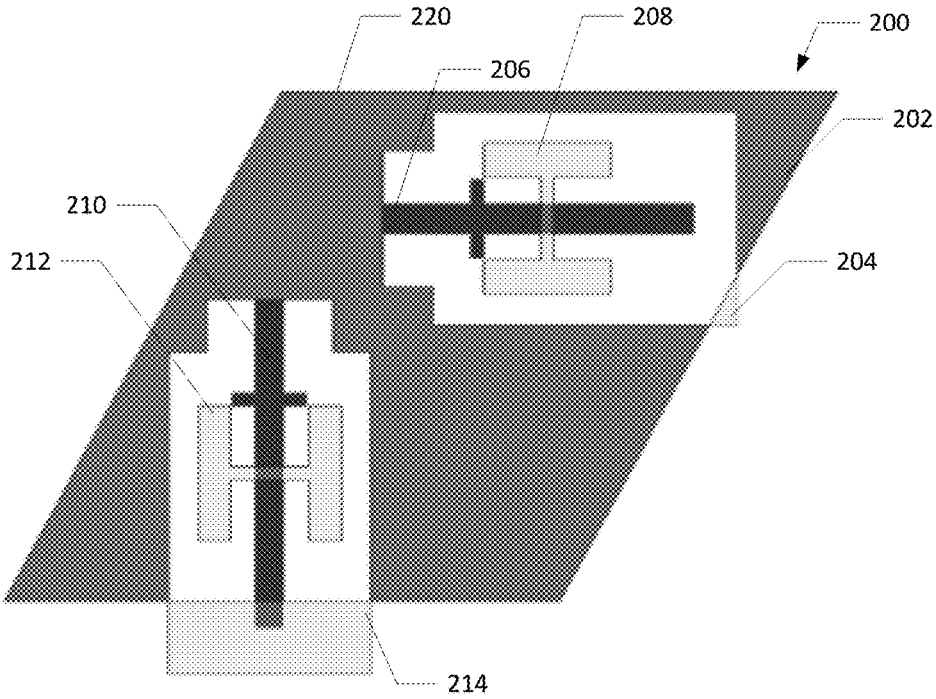
FIG. 2 shows a top view of a stripline feed layer and ground plane with two slots of a dual polarized radiating element according to various embodiments.

FIG. 2 shows a top view of a stripline feed layer and ground plane with two slots of a dual polarized radiating element according to various embodiments.

FIG. 2 illustrates a radiating element cell 200 formed in a ground plane layer 202. may include metal therein to define a horizontal stripline feed 206 and a vertical stripline feed 210. The ground plane layer 202 may define an imaginary triangular grid unit cell boundary 220 for the radiating element cell 200.

The horizontal stripline feed 206 may be disposed below a horizontal polarization ground plane slot 208 formed by a high dielectric constant material 204. Portions of the high dielectric constant material 204 may lay outside the imaginary triangular grid unit cell boundary 220.

The vertical stripline feed 210 may be disposed below a vertical polarization ground plane slot 212 formed by a high dielectric constant material 214. Portions of the high dielectric constant material 214 may lay outside the triangular grid unit cell boundary 220.

Figure 3:
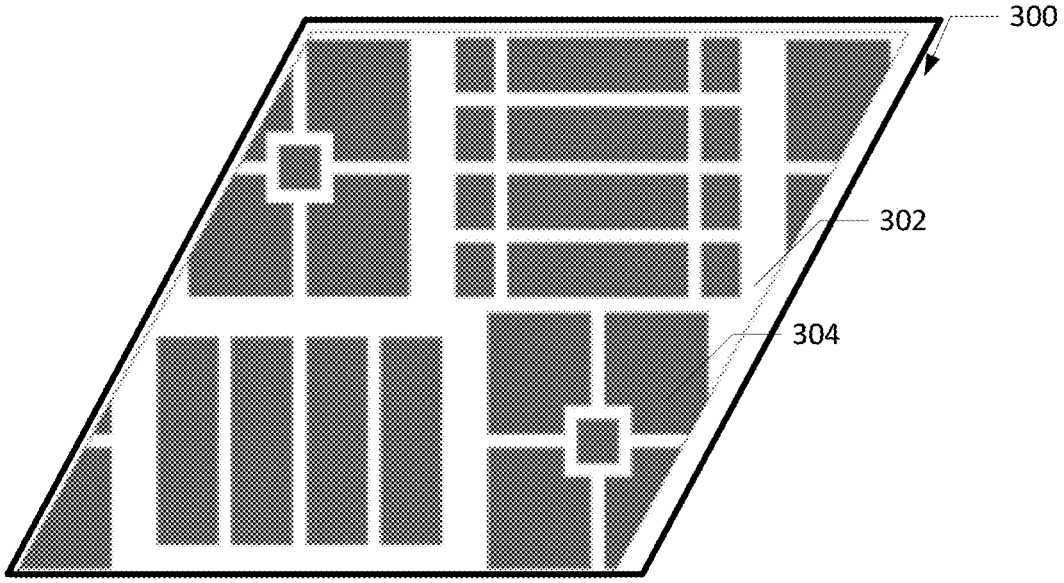
FIG. 3 shows a top view of a lower metallization layer of a radiating element according to various embodiments.

FIG. 3 shows a top view of a lower metallization layer of a radiating element according to various embodiments.

Referring to FIG. 3, a radiating element 300 includes a HOFS layer on a dielectric material substrate, for example, Rogers 4003. The a HOFS layer 302 includes a plurality of metallic squares 304, organized to tune the radiating element in a particular frequency range and balance additional metal layers as described herein.

Figure 4:
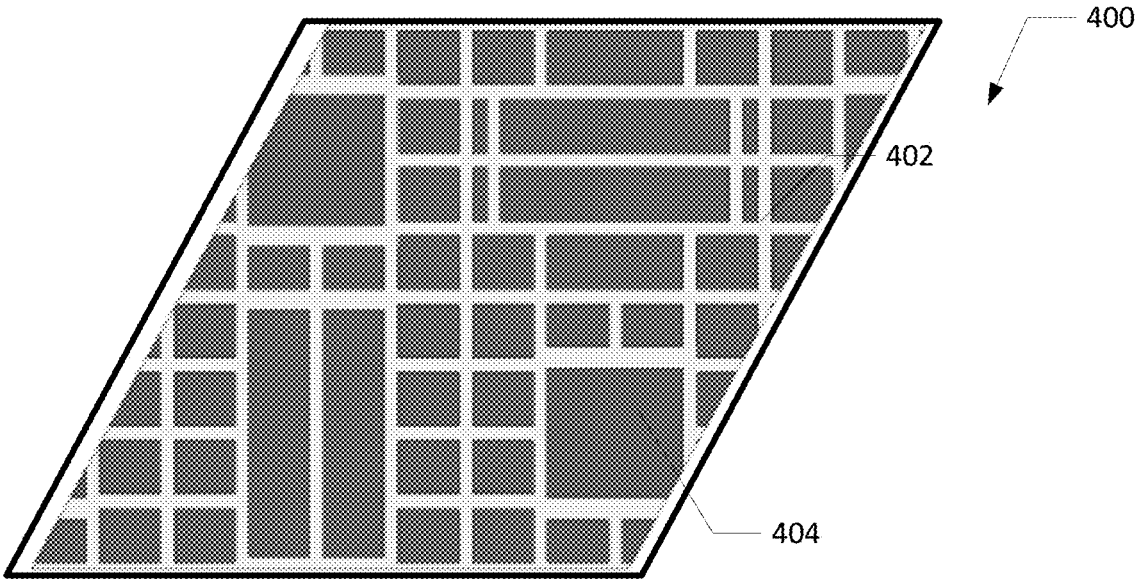
FIG. 4 shows a top view of an upper metallization layer of a radiating element according to various embodiments.

FIG. 4 shows a top view of an upper metallization layer of a radiating element according to various embodiments.

Referring to FIG. 4, a radiating element 400 includes an upper metallization layer (HOFS layer) 402 on a dielectric material substrate such as Rogers 4003. The upper metallization layer 402 includes a plurality of metallic squares 404, organized to tune the radiating element in a particular frequency range and balance additional metal layers as described herein.

Figure 5:
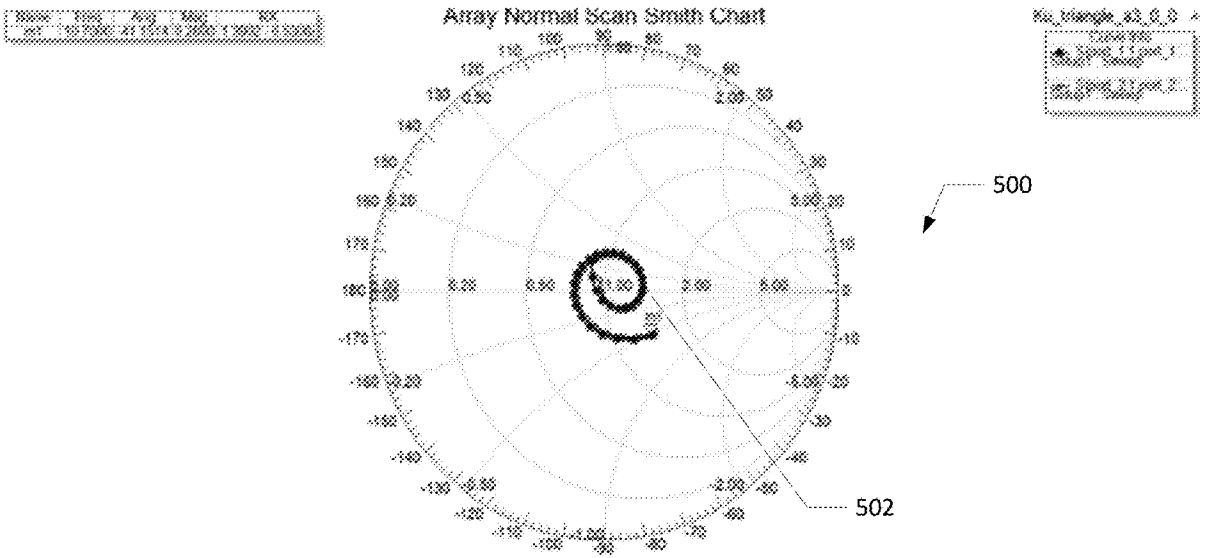
FIG. 5 shows a graphical representation of the performance of a radiating element according to various embodiments.

Referring to FIG. 5, a Smith chart 500 illustrates the performance of a radiating element operating with θ (theta) of 0 degrees and φ (phi) of 0 degrees is shown in a frequency range of 10.7 to 14.5 GHz. Performance is measured as return loss in decibels. Return loss is shown for a horizontal polarization 504 and a vertical polarization 502.

Figure 6:
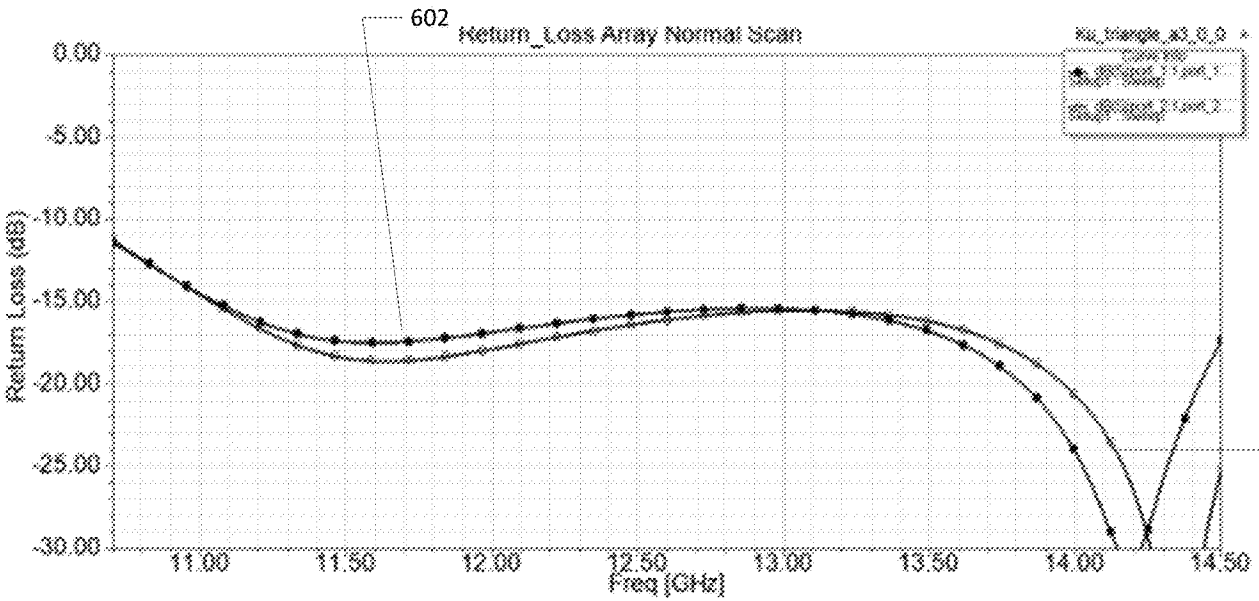
FIG. 6 shows a graphical representation of the performance of a radiating element according to various embodiments.

Referring to FIG. 6, a rectangular plot 600 illustrates the performance of a radiating element operating with θ (theta) of 0 degrees and φ (phi) of 0 degrees is shown in a frequency range of 10.7 to 14.5 GHz. Performance is measured as return loss in decibels. Return loss is shown for a horizontal polarization 604 and a vertical polarization 602.

Figure 7:
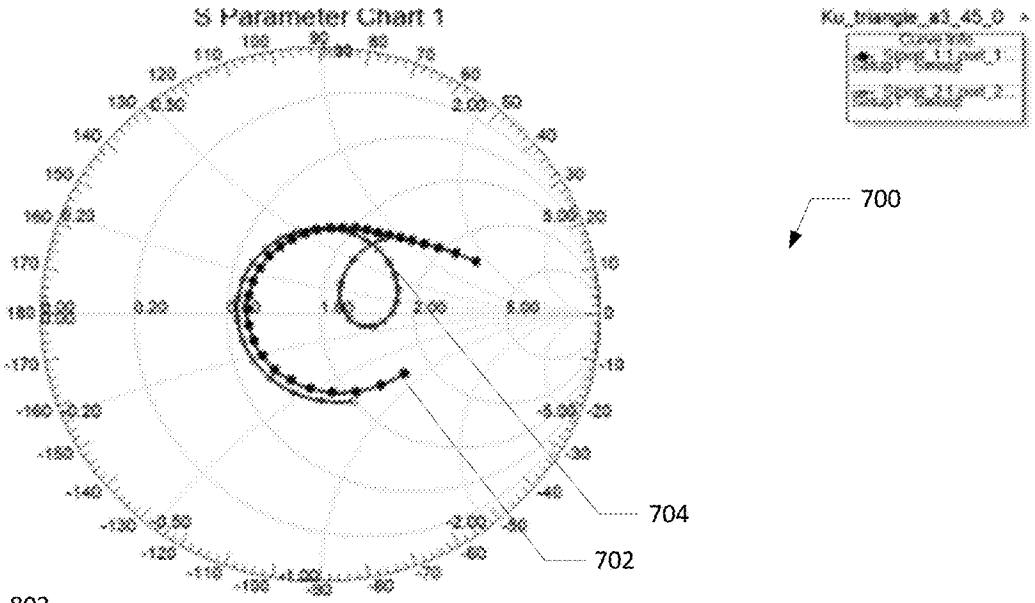
FIG. 7 shows a graphical representation of the performance of a radiating element according to various embodiments.

Referring to FIG. 7, a Smith chart 700 illustrates the performance of a radiating element operating with θ (theta) of 45 degrees and φ (phi) of 0 degrees is shown in a frequency range of 10.7 to 14.5 GHz. Performance is measured as return loss in decibels. Return loss is shown for a horizontal polarization 704 and a vertical polarization 702.

Figure 8:
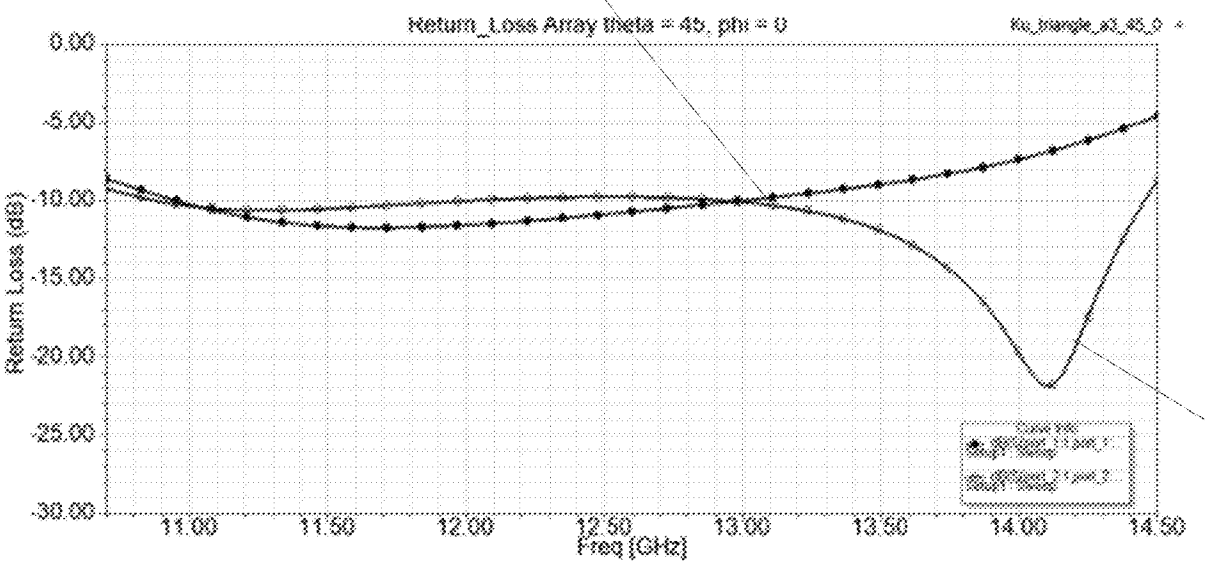
FIG. 8 shows a graphical representation of the performance of a radiating element according to various embodiments.

Referring to FIG. 8, a rectangular plot 800 illustrates the performance of a radiating element operating with θ (theta) of 45 degrees and φ (phi) of 0 degrees is shown in a frequency range of 10.7 to 14.5 GHz. Performance is measured as return loss in decibels. Return loss is shown for a horizontal polarization 804 and a vertical polarization 802.

Figure 9:
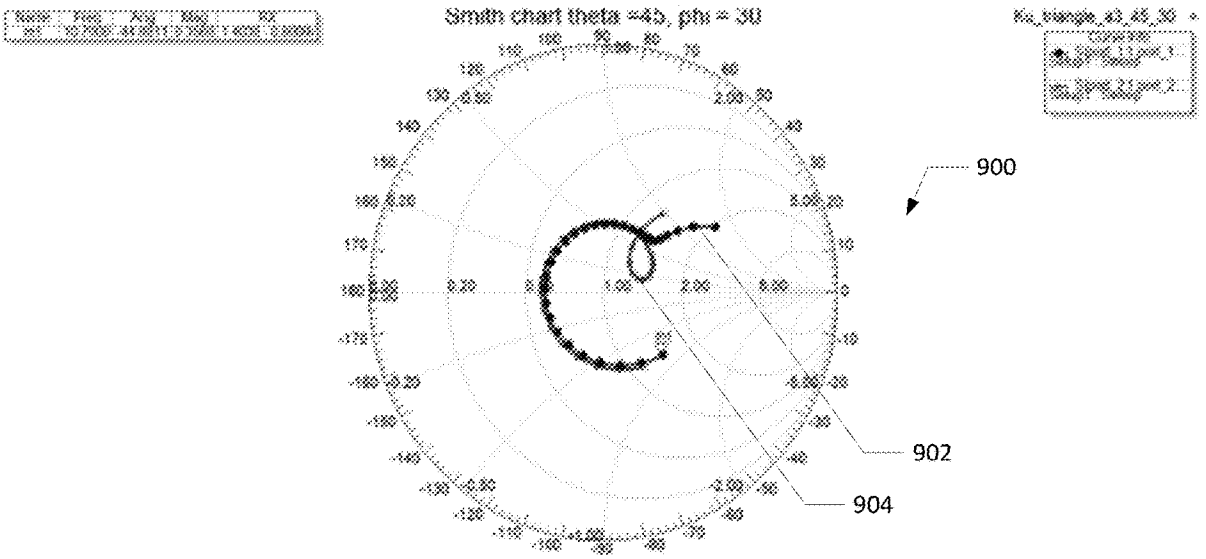
FIG. 9 shows a graphical representation of the performance of a radiating element according to various embodiments.

Referring to FIG. 9, a Smith chart 900 illustrates the performance of a radiating element operating with θ (theta) of 45 degrees and φ (phi) of 30 degrees is shown in a frequency range of 10.7 to 14.5 GHz. Performance is measured as return loss in decibels. Return loss is shown for a horizontal polarization 904 and a vertical polarization 902.

Figure 10:
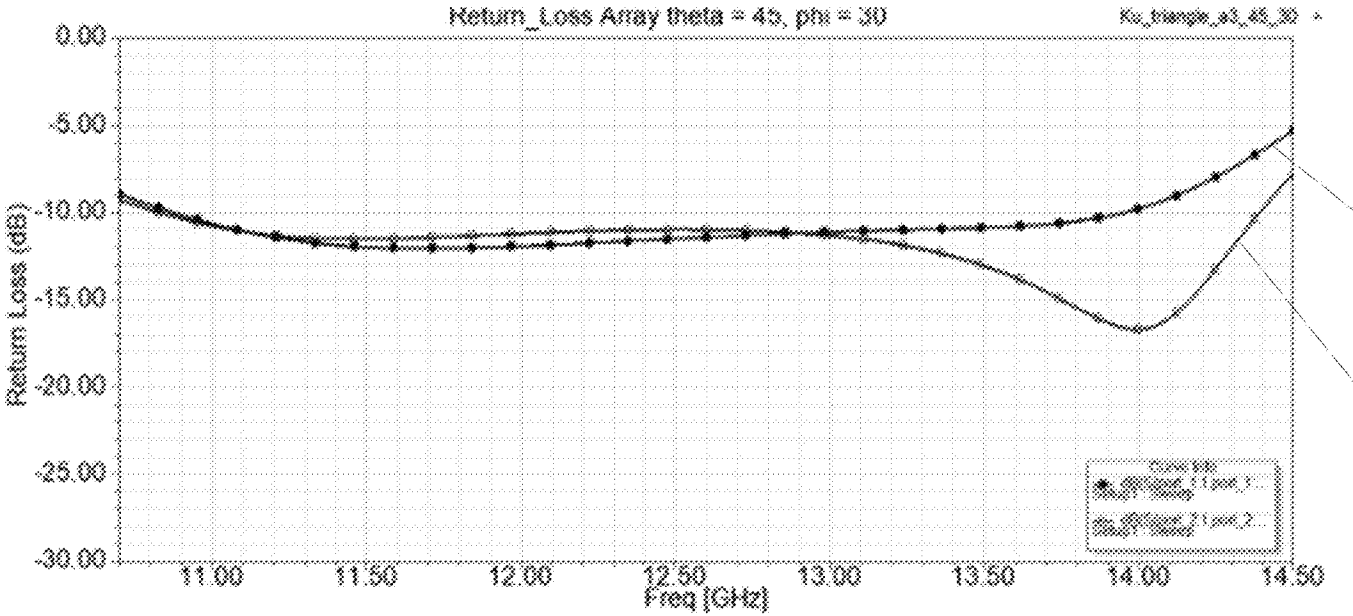
FIG. 10 shows a graphical representation of the performance of a radiating element according to various embodiments.

Referring to FIG. 10, a rectangular plot 1000 illustrates the performance of a radiating element operating with θ (theta) of 45 degrees and φ (phi) of 30 degrees is shown in a frequency range of 10.7 to 14.5 GHz. Performance is measured as return loss in decibels. Return loss is shown for a horizontal polarization 1004 and a vertical polarization 1002.

Figure 11:
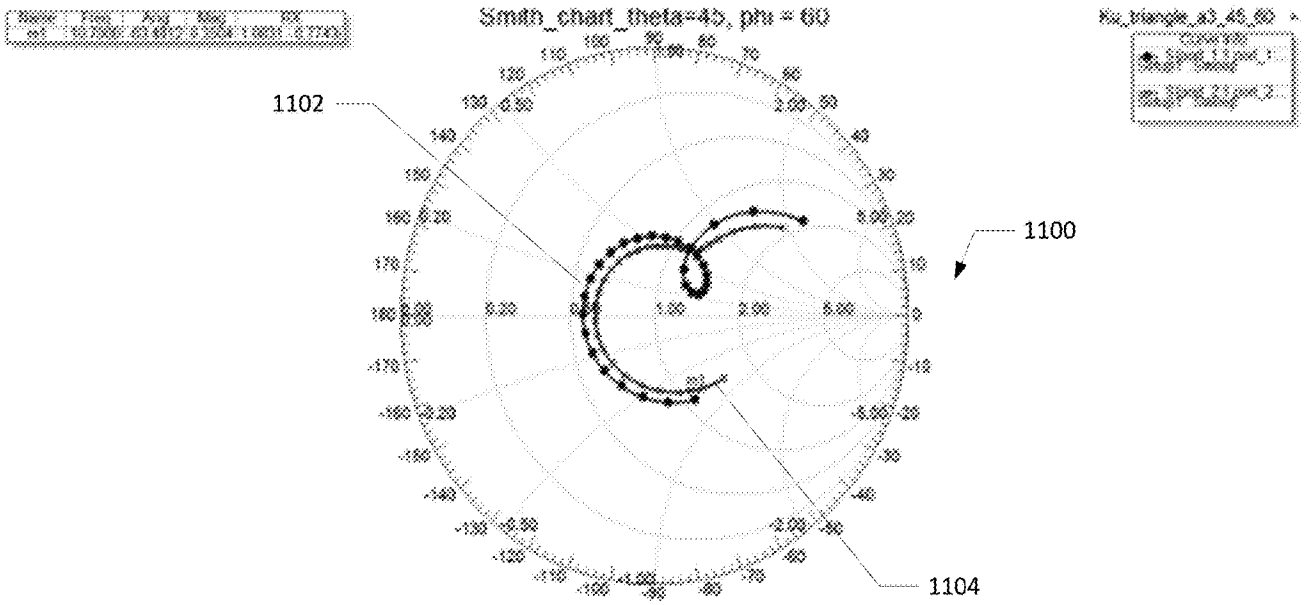
FIG. 11 shows a graphical representation of the performance of a radiating element according to various embodiments.

Referring to FIG. 11, a Smith chart 1100 illustrates the performance of a radiating element operating with θ (theta) of 45 degrees and φ (phi) of 60 degrees is shown in a frequency range of 10.7 to 14.5 GHz. Performance is measured as return loss in decibels. Return loss is shown for a horizontal polarization 1104 and a vertical polarization 1102.

Figure 12:
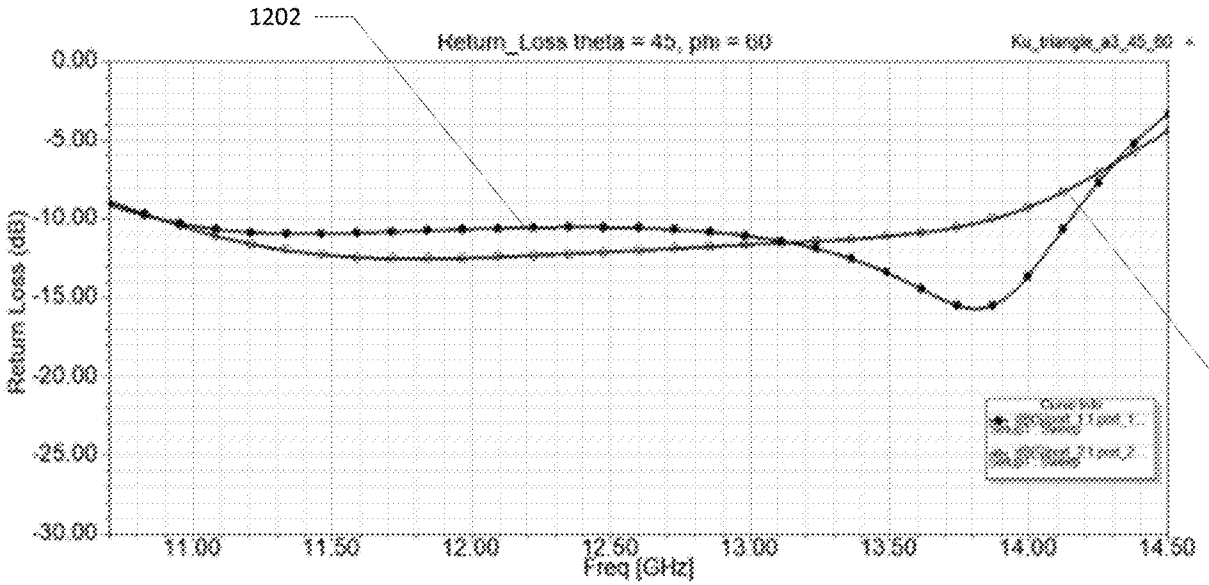
FIG. 12 shows a graphical representation of the performance of a radiating element according to various embodiments.

Referring to FIG. 12, a rectangular plot 1200 illustrates the performance of a radiating element operating with θ (theta) of 45 degrees and φ (phi) of 60 degrees is shown in a frequency range of 10.7 to 14.5 GHz. Performance is measured as return loss in decibels. Return loss is shown for a horizontal polarization 1204 and a vertical polarization 1202.

Figure 13:
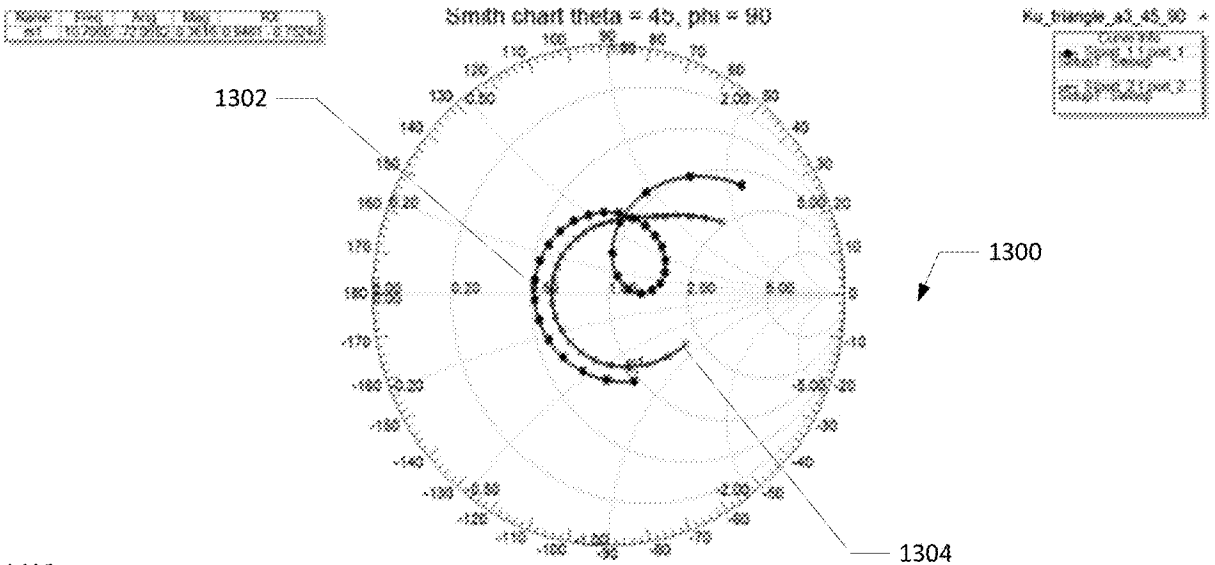
FIG. 13 shows a graphical representation of the performance of a radiating element according to various embodiments.

Referring to FIG. 13, a Smith chart 1300 illustrates the performance of a radiating element operating with θ (theta) of 45 degrees and φ (phi) of 90 degrees is shown in a frequency range of 10.7 to 14.5 GHz. Performance is measured as return loss in decibels. Return loss is shown for a horizontal polarization 1304 and a vertical polarization 1302.

Figure 14:
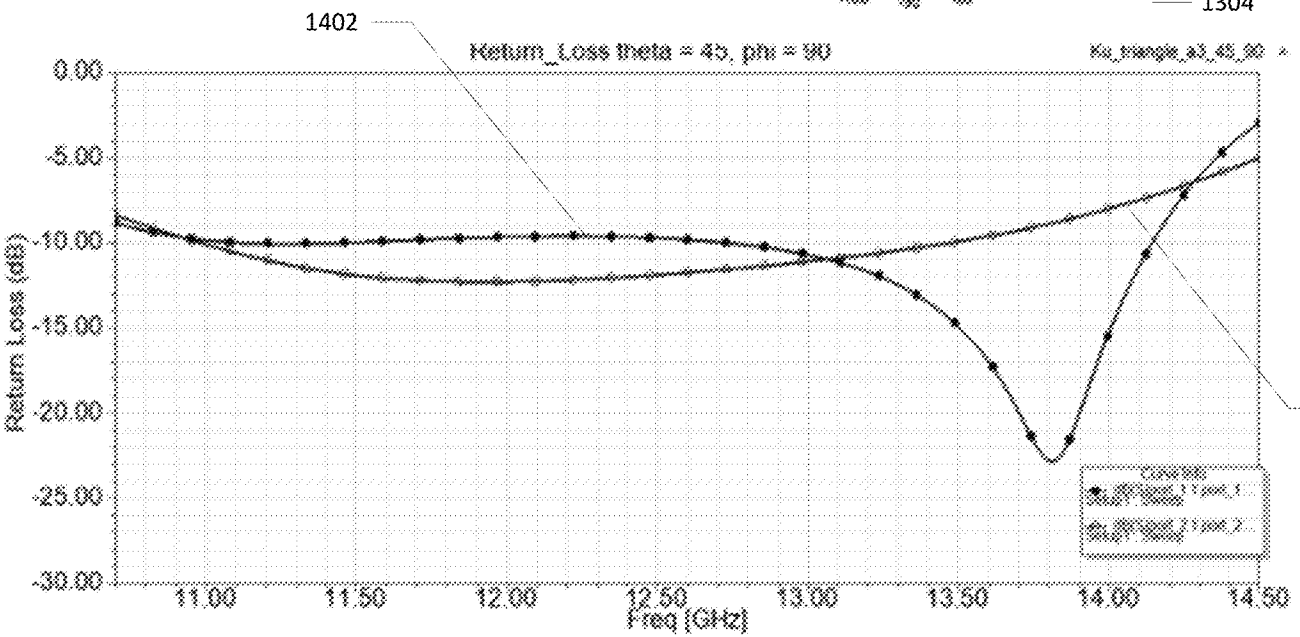
FIG. 14 shows a graphical representation of the performance of a radiating element according to various embodiments.

Referring to FIG. 14, a rectangular plot 1400 illustrates the performance of a radiating element operating with θ (theta) of 45 degrees and φ (phi) of 90 degrees is shown in a frequency range of 10.7 to 14.5 GHz. Performance is measured as return loss in decibels. Return loss is shown for a horizontal polarization 1404 and a vertical polarization 1402.

Figure 15:
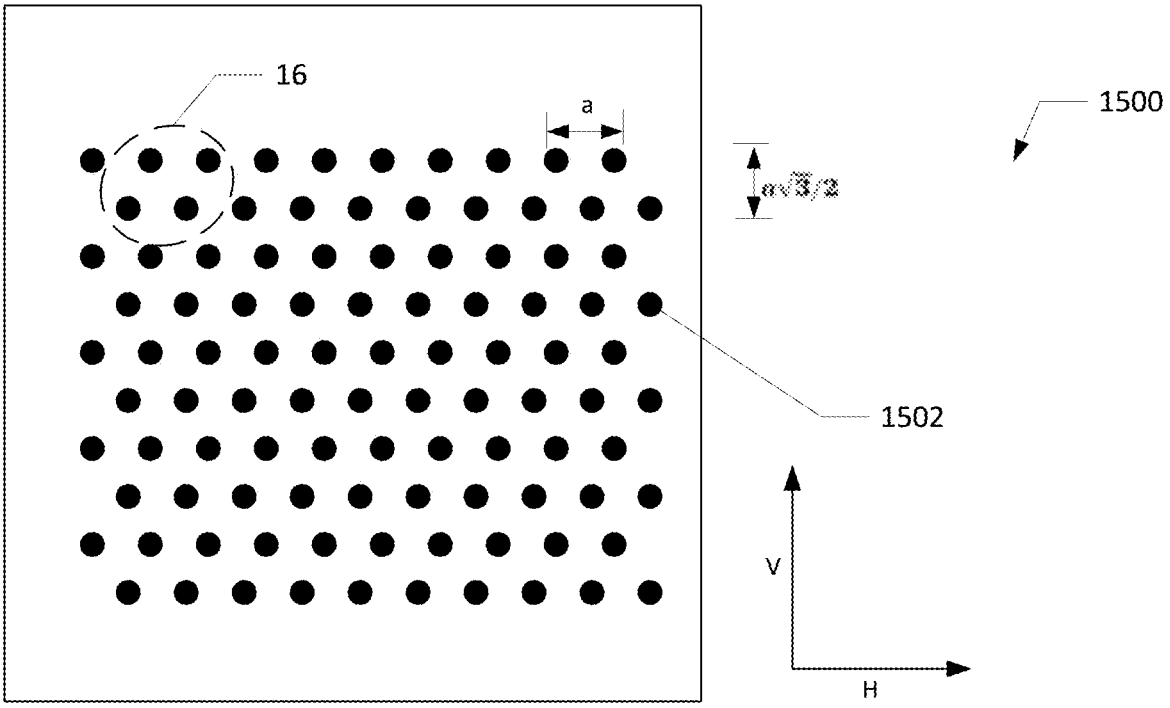
FIG. 15 illustrates an array including radiating elements disposed in an equilateral triangular grid array according to various embodiments.

FIG. 15 illustrates an array including radiating elements disposed in an equilateral triangular grid array according to various embodiments.

FIG. 15 illustrates an array 1500 including radiating elements 1502 are segregated and disposed in an equilateral triangular grid array. To form the array 1500, adjacent radiating elements 1502 may be disposed at a distance of a along the H-axis (horizontal), and at a distance of $a\sqrt{3}/2$ along the V-axis (vertical). Each row or column of the radiating elements 1502 maybe viewed as a cluster, for example.

Figure 16:
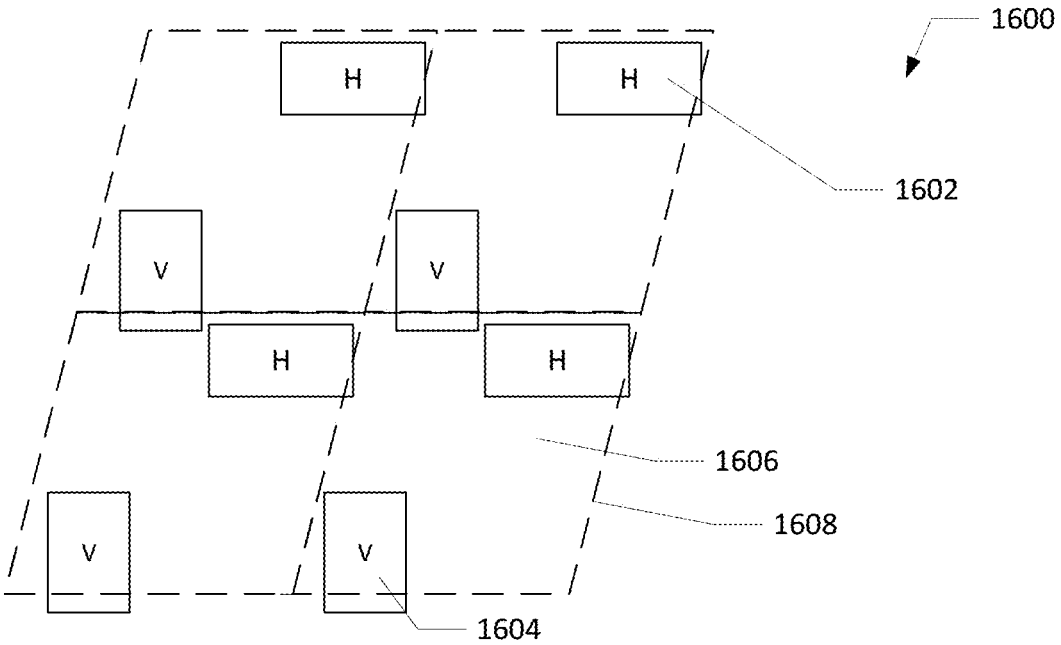
FIG. 16 illustrates an enlargement of the array of FIG. 15.

FIG. 16 illustrates an enlargement of the array of FIG. 15.

An equilateral triangular array 1600 may include a plurality of radiating element cells 1606. Each of the radiating element cells 1606 may include a horizontal stripline 1602 and a vertical stripline 1604. Each of the radiating element cells 1606 may be defined by an imaginary boundary 1608.

Although the subject matter has been described in language specific to structural features and/or methodological acts, it is to be understood that the subject matter in the appended claims is not necessarily limited to the specific features or acts described above. Rather, the specific features and acts described above are disclosed as example forms of implementing the claims. Other configurations of the described embodiments are part of the scope of this disclosure. Further, implementations consistent with the subject matter of this disclosure may have more or fewer acts than as described or may implement acts in a different order than as shown. Accordingly, the appended claims and their legal equivalents should only define the invention, rather than any specific examples given.

We claim as our invention:

1. A low-profile radiating element comprising:

a stripline feed layer, wherein the stripline feed layer comprises a metal therein as a horizontal stripline feed and a vertical stripline feed, and wherein the horizontal stripline feed is disposed below a horizontal polarization ground plane slot and the vertical stripline feed is disposed below a vertical polarization ground plane slot;

a High Order Floquet (HOFS) part layer; and a radome layer in direct contact with the HOFS part layer, wherein the HOFS part layer is disposed between the stripline feed layer and the radome layer, and the radiating element operates with a scan angle θ from 0° to 45° and a γ scan angle from 0° and 360°.

2. The radiating element of claim 1, wherein the HOFS part layer comprises a first cluster of metallic striplines, generally elongated along a first axis, to produce a first signal having a first polarization, a second cluster of metallic striplines, generally elongated along a second axis substantially orthogonal to the first axis, to produce a second signal having a second polarization substantially orthogonal to the first polarization, and the first cluster is segregated from the second cluster.

3. The radiating element of claim 2, wherein the first cluster of metallic striplines is disposed in an equilateral triangular grid array.

4. The radiating element of claim 1, wherein the radiating element operates in a frequency range comprising 10.7 to 14.5 GHz.

5. The radiating element of claim 1, wherein the dielectric constant of the HOFS part layer is between 3.3 and 3.7.

6. The radiating element of claim 1, wherein the radome layer comprises a quartz layer and is integrated with the HOFS part layer.

7. The radiating element of claim 1, wherein there is no gap between the HOFS part layer and the radome layer.

8. The radiating element of claim 1, wherein the HOFS part layer comprises an FR-4 material.

9. The radiating element of claim 1, wherein the stripline feed layer, the HOFS part layer and the radome layer together form a PCB stack having a cross-section depth is less than or equal to 100 mils (2.54 millimeter).

10. An array comprising:

a plurality of low-profile radiating elements, each radiating element comprising a stripline feed layer; a High Order Floquet (HOFS) part layer; and a radome layer in direct contact with the HOFS part layer, wherein the stripline feed layer includes a metal therein as a horizontal stripline feed and a vertical stripline feed, and wherein the horizontal stripline feed is disposed below a horizontal polarization ground plane slot and the vertical stripline feed is disposed below a vertical polarization ground plane slot, wherein the HOFS part layer is disposed between the stripline feed layer and the radome layer, and the radiating elements operate with a scan angle θ from 0° to 45° and a γ scan angle from $0° \leq \gamma \leq 360°$.

11. The array of claim 10, wherein the radome layer comprises a layer of quartz.

12. The array of claim 10, wherein the low-profile radiating element operates in Ku and X frequency bands.

13. The array of claim 10, wherein the low-profile radiating element operates in a frequency range comprising 10.7 to 14.5 GHz.

14. The array of claim 10, wherein the HOFS layer further comprises an upper metallization layer including a plurality of metallic striplines organized with substantial bilateral symmetry along both a first axis and a second axis orthogonal to the first axis.

* * * * *